US011234497B2

(12) United States Patent
Hinds et al.

(10) Patent No.: US 11,234,497 B2
(45) Date of Patent: Feb. 1, 2022

(54) TWO-PART CONNECTING RING

(71) Applicant: Collide LLC, Cos Cob, CT (US)

(72) Inventors: Kristen Hinds, Cos Cob, CT (US); Gavin Smith, Cos Cob, CT (US)

(73) Assignee: Collide LLC, Stamford, CT (US)

( * ) Notice: Subject to any disclaimer, the term of this patent is extended or adjusted under 35 U.S.C. 154(b) by 91 days.

(21) Appl. No.: 16/656,135

(22) Filed: Oct. 17, 2019

(65) Prior Publication Data

US 2021/0112928 A1 Apr. 22, 2021

(51) Int. Cl.
*A44C 9/00* (2006.01)

(52) U.S. Cl.
CPC ..... *A44C 9/0023* (2013.01)

(58) Field of Classification Search
CPC ..... A44C 9/0023; A44C 9/00; A44C 9/0007; A44C 9/0015; A44C 9/003
USPC ..... 63/15.1
See application file for complete search history.

(56) References Cited

U.S. PATENT DOCUMENTS 1,712,417 A * 5/1929 Beaujard, Jr. ..... A44C 9/003 63/15.3
5,228,316 A * 7/1993 Meyrowitz ..... A44C 17/0258 63/15.4
6,484,536 B1 * 11/2002 Gould ..... A44C 9/0023 63/15
2010/0050690 A1 * 3/2010 Woodward ..... A44C 5/0007 63/15.1

FOREIGN PATENT DOCUMENTS

EP 1767113 A1 * 3/2007 ..... A44C 9/0023
FR 2440704 A1 * 6/1980 ..... A44C 9/0023
WO WO-2004095969 A1 * 11/2004 ..... A44C 9/0023

* cited by examiner

*Primary Examiner* — Jack W Lavinder

(74) *Attorney, Agent, or Firm* — Whitmyer IP Group LLC; Jadira De La Torre

(57) ABSTRACT

A ring system having a first ring and a second ring, each ring having an inner circumferential surface, an outer circumferential surface, a first surface and an opposing second surface. The first ring and the second ring each have a fastener on the respective first surfaces and the first ring and the second ring each releasably fasten to each other causing the first surfaces of the rings to abut. Each outer circumferential surface has an outer diameter, the outer diameter being the largest diameter of the outer circumferential surface. The first ring and the second ring each have an edge where the first surface and the outer circumferential surface intersect. The diameter of the edge of the first ring is equal to the outer diameter of the first ring and the diameter of the edge of the second ring is equal to the outer diameter of the second ring.

20 Claims, 8 Drawing Sheets

TWO-PART CONNECTING RING

TECHNICAL FIELD

The present teaching is related to the field of connectable jewelry rings and different elements used to connect them.

BACKGROUND

Rings can be worn for practical, religious, and aesthetic reasons. Rings can serve as jewelry, protection, or identification devices. The typical design of a ring is circular in shape with an opening through which an appendage, often a finger or toe, is passed. A ring through which an appendage has passed through its opening is considered to be "worn." Rings can be retained on the appendage by sizing them such that they do not freely slide along the appendage during average appendage movement. Rings can also be retained on an appendage through use of a mechanism that decreases the size of the opening or closes the ring around the appendage.

More than one ring can be worn on a single appendage. The number, type, and sequence of rings worn on a single appendage can be selected because of personal preference, religious ritual or requirement, aesthetic value, fashion, practical considerations, sentimental considerations, conspicuous consumption, communication or signaling, or any combination of these reasons. When worn, rings can butt against each other on the appendage. When removed from the appendage, the multiple rings often are not connected together such that a wearer must remember which order they were in when removed. A device that fixes at least two rings together is needed in situations where the positional relationship of at least two rings on a single appendage is desired. The device disclosed herein relates to providing at least two rings that are fastenable to each other into one assembly such that they may be worn on a single appendage.

It is known in the art ring systems that are constructible from two rings having corresponding threads. However, these systems have a groove to retain a third piece, an inlay, and are undesirable when an inlay is not provided. Further, known ring systems do not provide individual rings that are desirable to wear. This is due to the individual rings having unpleasing visual appearance or rough or sharp surfaces and edges which can be irritating to a wearer. The ring system disclosed herein provides a wearer with at least one ring that is aesthetically pleasing and comfortable to wear independently from it corresponding ring of the ring system. Further, the disclosed ring system provides a pair of rings that assemble into one ring that does not require an inlay to be aesthetically pleasing. This is due to the two rings creating an aesthetically pleasing surface over the junction where the two rings connect. The two rings can create this surface by joining to create a smooth and continuous surface, or to have complementary features that together create a coherent design.

Further, a degree of customizability of a ring's design is desired. The material and configuration of a ring cannot be changed after a ring is manufactured. It is desired that there be a ring assembly made up of at least two rings that is assemblable and disassemblable by a user without the use of tools. Such a device should allow a user to mix and match combinations of rings made of different materials and shaped in different ways.

As such, there is a need for a device that provides at least two rings that are releasably fastened together such that their openings are coaxial and concentric to each other.

A notable advantage to providing a device where multiple rings can be releasably fastened is that they can be worn, removed from an appendage, and stored as one assembly. This feature can help a user store rings without the risk of misplacing a ring. A user can save time by putting the ring assembly on instead of multiple rings. A user can wear a plurality of rings in the same order on their finger without having to remember which order the rings go in. A user can make a fashion statement by wearing a ring assembly that, by assembling a plurality of rings into one assembly, looks like a single ring.

SUMMARY

The needs set forth herein as well as further and other needs and advantages are addressed by the present examples, which illustrate solutions and advantages described below.

The system of the present embodiment includes, but is not limited to the following examples.

One example of a ring system can include a first ring and a second ring, the first ring and the second ring each having an inner circumferential surface and an outer circumferential surface. The first ring and the second ring can each have a first surface and a second surface, the second surface opposing the first surface. The first ring and the second ring can each have a fastener on the respective first surfaces, the first ring and the second ring each releasably fastenable to each other using the fasteners to make a fastened state. The first and the second surfaces each radially extend from the inner circumferential surface to the outer circumferential surface. The first surface of the first ring and the first surface of the second ring abut each other when the first ring and the second ring are in the fastened state. Each outer circumferential surface having an outer diameter, the outer diameter being the largest diameter of the outer circumferential surface. The first ring and the second ring each having an edge where the first surface and the outer circumferential surface intersect, the diameter of the edge of the first ring being equal to the outer diameter of the first ring and the diameter of the edge of the second ring being equal to the outer diameter of the second ring.

Another example can include the ring system having the fastener of the first ring having a protrusion. The protrusion can have an outer circumferential surface smaller in diameter than the outer diameter of the first ring. The first surface of the second ring can have a cavity into which the protrusion of the first ring extends.

Another example can include the first ring having a magnet and the second ring having magnetic material.

Another example can include the first ring having magnetic material and the second ring having a magnet.

Another example can include the fastening feature of the first ring and of the second ring being a corresponding helical thread.

Another example can include the fastening feature of the first ring and of the second ring being a twist-to-lock connection.

Another example can include the fastening feature of the first ring being at least one pin and the fastening feature of the second ring being at least one bore.

Another example can include the cavity of the second ring being annular.

Another example can include the cavity of the second ring extending to the opening.

Another example can include the protrusion of the first ring being annular.

Another example can include the first ring having an overall height measured parallel to the central axis passing through the opening. The protrusion can have a height measured from the radially extending surface to the end of the protrusion and parallel to the axis passing through the opening. The height of the protrusion can be equal to less than half of the overall height of the first ring.

Another example of the system can include a third ring having an overall thickness measured perpendicular to an outer diameter of the third ring, an inner circumferential surface with a diameter and an outer circumferential surface with a diameter, a first surface, a second surface, and a fastener on the outer circumferential surface. The second surface can oppose the first surface. The first surface and the second surface can each radially extend from the inner circumferential surface to the outer circumferential surface. The cavity of the second ring can have a depth, the depth measured from the first surface of the second ring to a bottom surface of the cavity. The overall thickness of the third ring can be no larger than the depth of the cavity of the second ring. The second ring and the third ring can be releasably fastenable to each other using the fasteners to make a fastened state. The first surface of the third ring can abut the bottom surface of the cavity when the second ring and the third ring are in a fastened state. The fastener of the second ring and the fastener of the third ring can be interconnected when the second ring and the third ring are in the fastened state.

Another example can include the second ring having a protrusion extending from a second surface opposite the radially extending surface and a third ring, the third ring having an opening passing through the ring. The third ring can have a surface extending radially from the opening, the radially extending surface of the third ring abutting the second surface of the second ring. The surface extending radially from the opening of the third ring can have a cavity into which the protrusion of the second ring extends.

Another example can include a first ring, the first ring having an inner circumferential surface, an outer circumferential surface, a first surface, a second surface, the first and the second surfaces each radially extending from the inner circumferential surface to the outer circumferential surface, the second surface opposing the first surface, and a fastener on the first surface. The system can also include a second ring, the second ring having an inner circumferential surface, an outer circumferential surface, a first surface, a second surface, the first and the second surfaces each radially extending from the inner circumferential surface to the outer circumferential surface, the second surface opposing the first surface, and a fastener on the first surface. The first ring and the second ring each releasably fasten to each other using the fasteners to make a fastened state. The first surface of the first ring and the first surface of the second ring abut each other when the first ring and the second ring are in the fastened state. The outer circumferential surface of the first ring has an outer diameter, the outer diameter being the largest diameter of the outer circumferential surface of the first ring. The outer circumferential surface of the second ring has an outer diameter, the outer diameter being the largest diameter of the outer circumferential surface of the second ring. The first ring and the second ring each have an edge where the first surface and the outer circumferential surface intersect, the diameter of the edge of the first ring being equal to the outer diameter of the first ring and the diameter of the edge of the second ring being equal to the outer diameter of the second ring.

Another example can include a first ring and a second ring, the first ring and the second ring each having an inner circumferential surface and an outer circumferential surface. The first ring and the second ring each can have a first surface and a second surface, the second surface opposing the first surface. The first and the second surfaces can each radially extend from the inner circumferential surface to the outer circumferential surface. The first ring can have a fastener on the first surface, the fastener being a cavity in the first surface, a depth of the cavity measured from the first surface to a bottom surface. The second ring can have a fastener on the outer circumferential surface. The first ring and the second ring can each releasably fasten to each other using the fasteners to make a fastened state. The bottom surface of the cavity and the first surface of the second ring can abut each other when the first ring and the second ring are in the fastened state. The fasteners of the first ring and the second ring can interconnect when the first ring and the second ring are in a fastened state.

Other embodiments of the system and method are described in detail below and are also part of the present teachings.

DETAILED DESCRIPTION

The present teachings are described more fully hereinafter with reference to the accompanying drawings, in which the present embodiments are shown. The following description is presented for illustrative purposes only and the present teachings should not be limited to these embodiments. Any computer configuration and architecture satisfying the speed and interface requirements herein described may be suitable for implementing the system and method of the present embodiments.

In compliance with the statute, the present teachings have been described in language more or less specific as to structural and methodical features. It is to be understood, however, that the present teachings are not limited to the specific features shown and described, since the systems and methods herein disclosed comprise preferred forms of putting the present teachings into effect.

For purposes of explanation and not limitation, specific details are set forth such as particular architectures, interfaces, techniques, etc. in order to provide a thorough understanding. In other instances, detailed descriptions of well-known devices, circuits, and methods are omitted so as not to obscure the description with unnecessary detail.

Generally, all terms used in the claims are to be interpreted according to their ordinary meaning in the technical field, unless explicitly defined otherwise herein. All references to a/an/the element, apparatus, component, means, step, etc. are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second," etc. for different features/components of the present disclosure are only intended to distinguish the features/components from other similar features/components and not to impart any order or hierarchy to the features/components.

To aid the Patent Office and any readers of any patent issued on this application in interpreting the claims appended hereto, Applicant that it does not intend any of the appended claims or claim elements to invoke 35 U.S.C. 112(f) unless the words "means for" or "step for" are explicitly used in the particular claim.

Figure 1:
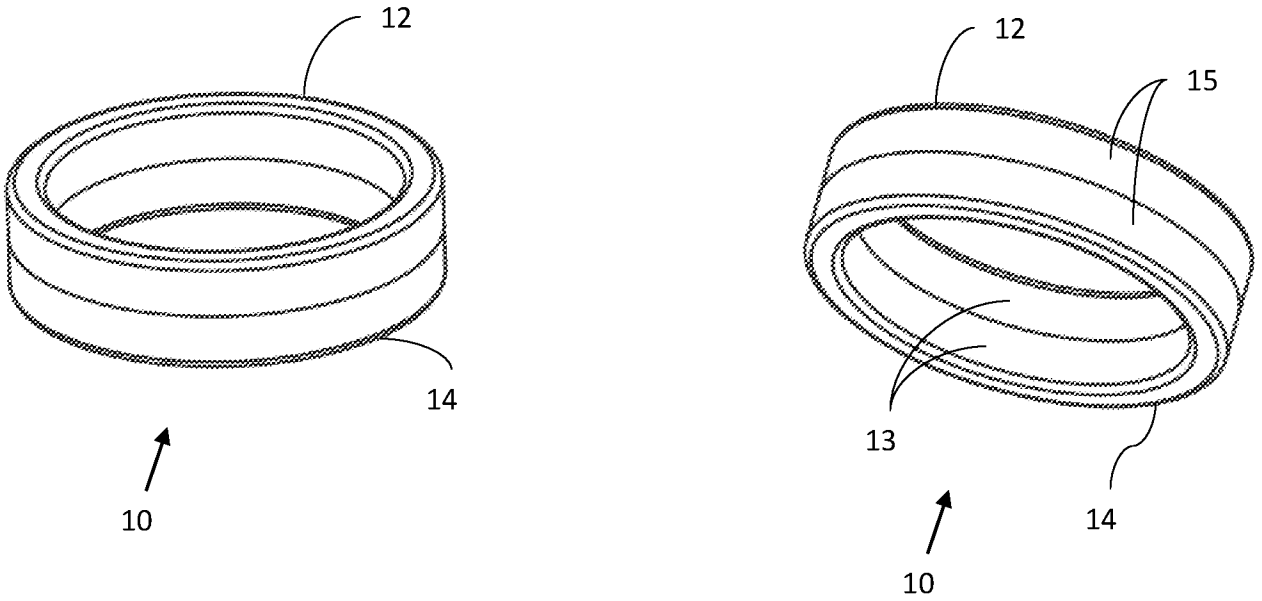
FIG. 1 is an example of the ring system in an assembled state. The main ring and the accessory ring are assembled into one ring assembly using a fastener.

Referring to FIG. 1, an example of the device 10 is shown. A main ring 12 and an accessory ring 14 are shown assembled in a releasably fastened state. FIG. 1 depicts rings that are circular in shape with a uniform cross section around the entire ring. The rings can be non-circular in shape. Both the main ring 12 and the accessory ring 14 can have an inner circumferential surface 13 and an outer circumferential surface 15.

The rings 12 and 14 can have a non-uniform cross section. Cross sections of the ring can include, but are not limited to, round, square, oval, d-shape, half moon, or any combination of geometric shapes known in the art. The main ring and the accessory ring can have the same or different shapes and/or cross sections.

Although not required, the rings 12 and 14 can have outer circumferential surface 15 profiles that are shaped to blend smoothly into each other when the rings 12 and 14 are in an assembled or secured state. Additionally, the rings 12 and 14 can have various ornamental shapes, grooves, and designs protruding from or formed into the circumferential surface 15 profiles.

The main ring 12 and the accessory ring 14 can be made from materials including, but not limited to, gold, silver, zinc, iron, nickel, platinum, stainless steel, silicon carbide, rose gold, white gold, green gold, bronze, copper, zinc, chrome, zirconium, Damascus steel, iron, steel, aluminum, plated metals, filled metals, metal alloys, plastic, rubber, silicone rubber, wood, bone, stone, precious stone, gemstone, mineral, crystal, glass, or any combination of materials known in the art. The main ring 12 and accessory ring 14 can be made out of the same material or different materials. The main ring 12 and the accessory ring 14 can be made of a homogenous material or a combination of materials. The main ring 12 and the accessory ring 14 can be made by casting, forging, molding, cutting, forming, or any other method of making a ring known in the art.

Referring to FIGS. 2 through 6, the main ring 12 and the accessory ring 14 are shown disconnected from each other. The main ring has a protrusion 16 that protrudes from a surface 18 of the main ring 12. This protrusion 16 can be annular or ring-like in shape and completely surround the opening 20 of the main ring 12. The protrusion 16 can be annular or ring-like in shape, yet not be continuous around the entire opening 20 or the main ring 12, but instead made up of at least one arcuate protrusion making up only a portion of a ring-like shape. The protrusion 16 can be any number of arcuate protrusions presenting as tabs with spaces between the tabs.

Figure 2:
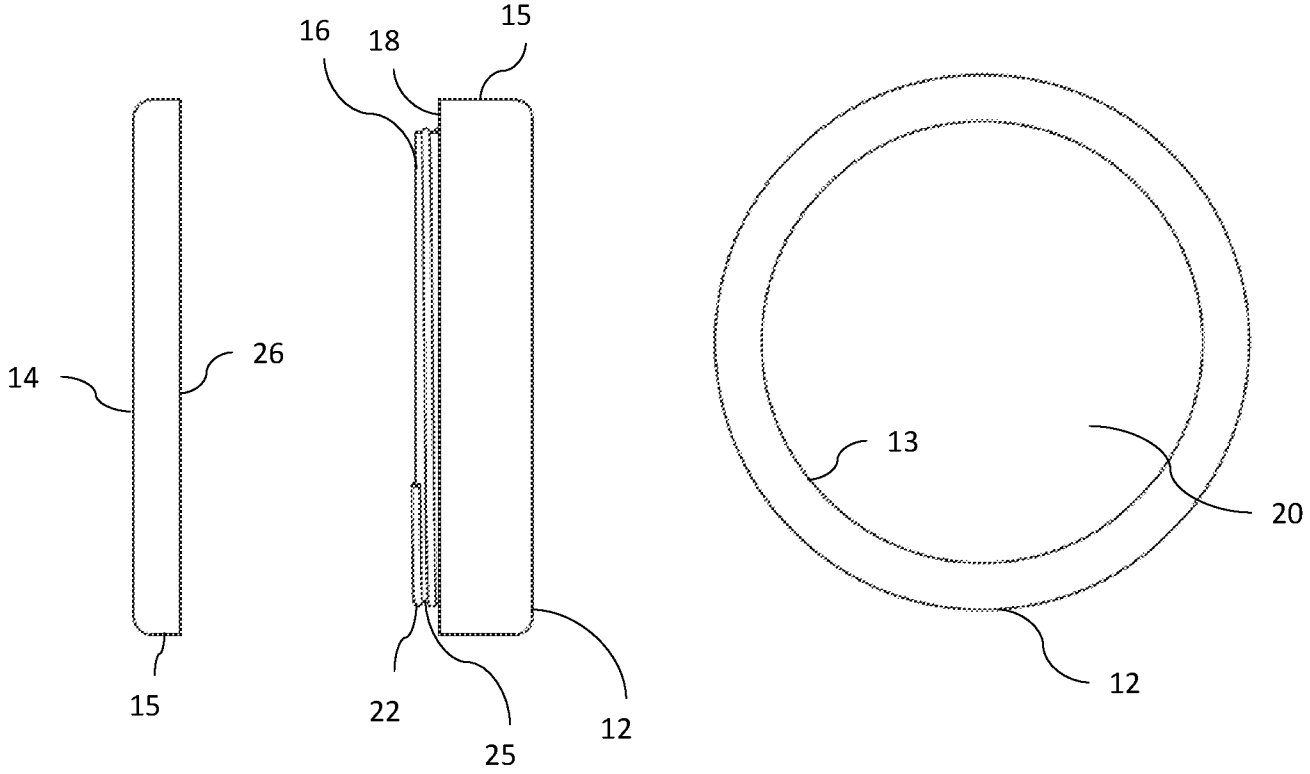
FIG. 2 is an example of the ring system in a disassembled state. The main ring and the accessory ring have helical threads for fasteners.

Referring to FIG. 2, the protrusion 16 can have a helical thread 22 on the outside circumferential surface 25 of the protrusion 16. The protrusion 16 and helical thread 22 can be sized such that at any number of threads are formed, including partial threads. The number of threads on the protrusion 16 can determine the number of turns required to secure the main ring 12 to an accessory ring 14.

The helical thread 22 can be a unified national fine thread, unified national course thread, acme thread, square thread, round thread, molded thread, custom-designed thread, proprietary thread, or any other thread known in the art. The thread 22 can have more than one lead. The type of thread can determine the single-thread cross section of the thread 22.

Figure 3:
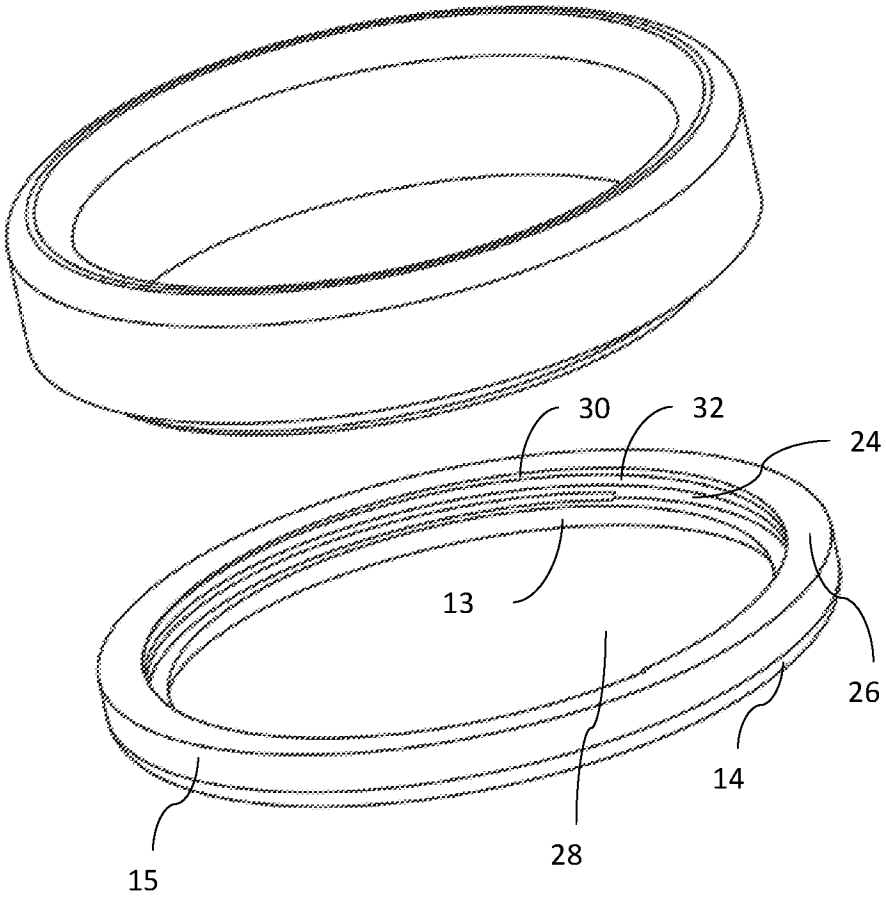
FIG. 3 is an example of the ring system in a disassembled state. The main ring and the accessory ring have helical threads for fasteners.

Referring to FIG. 3, the accessory ring 14 can have a cavity 24 that extends into the accessory ring 14 from a surface 26 of the accessory ring 14. The cavity 24 can extend to the inner circumferential surface 13 of the accessory ring or it can not extend to the circumferential surface 13. An example of the cavity 24 not extending to the circumferential surface 13 is a cavity 24 in the form of an annular groove in the surface 26. The cavity 24 can be annular in shape and completely surround the opening 28 or the cavity 24 can be annular in shape and not be continuous, instead made up of at least one arcuate cavity.

The cavity 24 can have a helical thread 30 on an outer circumferential surface 32 of the cavity 24. The helical thread 30 can have a size and shape sufficient to allow the helical thread 30 to interlock with the helical thread 22. The helical thread 30 can have the same single thread cross section and nominal diameter as the helical thread 22 on the main ring protrusion 16 or a different single-thread cross section and nominal diameter. The helical thread 30 can have any number of threads in order to allow the rings 12 and 14 to be screwed together. The helical thread 30 can have more threads than, less threads than, or the same number of threads as the helical thread 22. The helical thread 30 can be designed such that when the rings 12 and 14 are screwed together, the surface 18 abuts the surface 26 or there is a space between the surfaces 18 and 26.

The protrusion 16 can have an inner surface that is larger in diameter than the inner circumferential surface 13. When the inner surface is larger in diameter than the inner circumferential surface 13, there can be a female helical thread 22 on an inner circumferential surface of the protrusion 16. In this case, the accessory ring 14 can have a cavity 24 that does not extend to the inner circumferential surface 13 of the accessory ring 14. Such a cavity 24 can be described as a groove. Additionally, the accessory ring 14 can have a male helical thread 30 on an inner circumferential surface (not depicted) of the cavity 24 (groove).

The protrusion 16 can have both male and female helical threads 22, the male thread on an outside circumferential surface 25 of the protrusion and the female thread an inner circumferential surface of the protrusion 16. Correspondingly, the cavity 24 can have a male helical thread on an inner circumferential surface (not depicted) of the cavity 24 and a female helical thread 30 on an inner circumferential surface 32 of the cavity 24 such that the threads interlock with the threads of the protrusion 16.

The helical threads 22 and 30 or the protrusion 16 and cavity 24 of the main ring and the accessory ring can be made of the same material as, or materials different from their corresponding rings 12 and 14. The threads 22 and 30 of the main ring 12 and the accessory ring 14 can be made out of the same material or different materials. The threads can be secured to each other so as to limit relational rotation between the main ring 12 and the accessory 14 through mechanical force, chemical adhesive, additional mechanical fastening device, or any other thread securing method known in the art.

Figure 4:
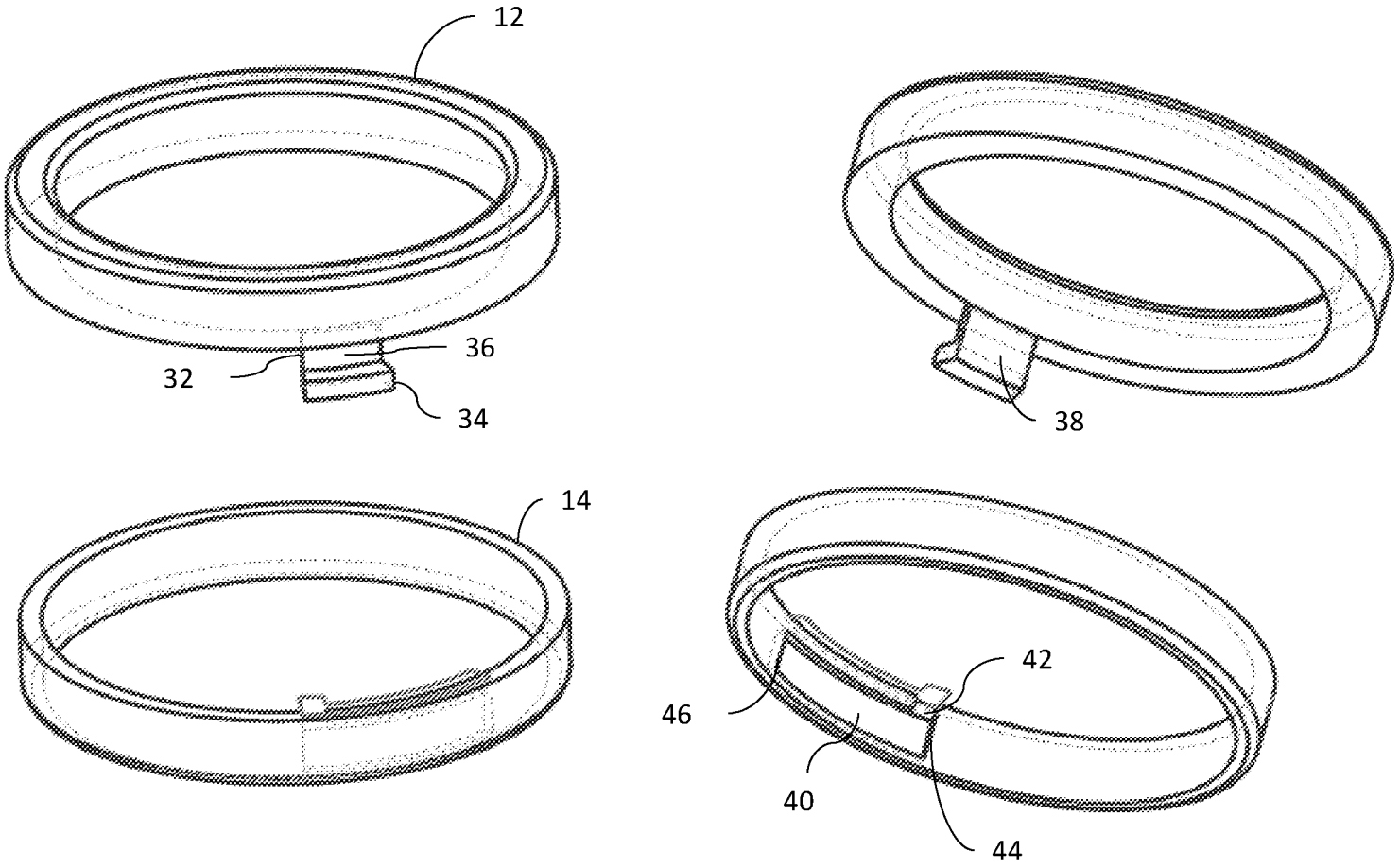
FIG. 4 is an example of the ring system in a disassembled state. The main ring and the accessory ring have a tab and slot fastener, also called a twist-and-lock fastener or a bayonet-style fastener.

Referring to FIG. 4, the main ring 12 can have a tab-like protrusion 32 used to secure the main ring 12 to the accessory ring 14. The tab-like protrusion 32 can have a hooking feature 34 that protrudes from a radially exterior surface 36 of the tab-like protrusion 32, a radially interior surface 38 of the tab-like protrusion 32, or separate hooking features 34 that extend from both radially exterior 36 and interior surfaces 38 of the tab-like protrusion 32.

The tab-like protrusion 32 can be annular and surround the entire opening 20 of the main ring similar to protrusion 16, or annular and not entirely surround the opening 20 of the main ring. The tab-like protrusion 32 can have one or more hooking features 34 on the radially exterior surface 36 and/or the radially interior surface 38 of the tab-like protrusion.

The rings 12 and 14 can be brought together such that the hooking feature 34 enters an access slot 42 in the inner circumferential surface 13 of the accessory ring 14 and passes to a circumferential slot 40 in the inner circumferential surface 13 of the accessory ring 14. The rings 12 and 14 can then be rotated in opposite directions from each other, thus moving the hooking element 34 from the free end 44 of the circumferential slot 40 towards the securing end 46 of the circumferential slot 40.

The rings 12 and 14 can be separated by rotating the rings 12 and 14 so that the hooking feature 34 moves towards the free end 44 of the circumferential slot 40. Once the hooking feature 34 is lined up with the access slot 42, the rings 12 and 14 can be separated by axially moving the rings away from each other.

The ring fastening device of FIG. 4 can be referred to as a twist-to-lock or bayonet fastening feature.

Figure 5:
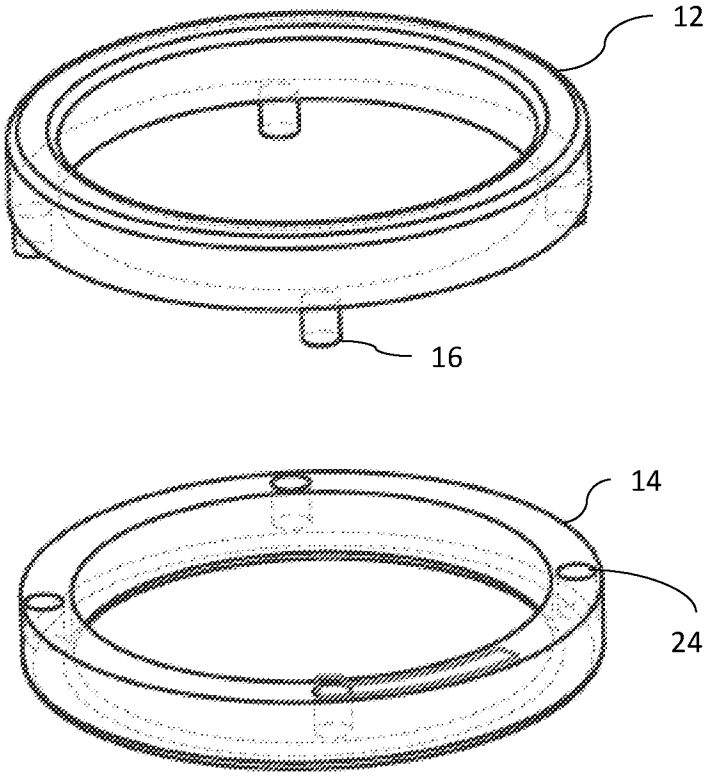
FIG. 5 is an example of the ring system in a disassembled state. The main ring and the accessory ring have a pin and bore system for a fastener.

Referring to FIG. 5, the main ring 12 can have a protrusion 16 from surface 18 in the form of at least one pin. The accessory ring 14 can have a cavity 24 in the form of at least one bore. The pin and the bore can be sized such that when the pin is pressed into the bore, a slight resistance is present and the rings 12 and 14 remain secured to each other. In this configuration, the rings 12 and 14 can be separated without tools.

Figure 6:
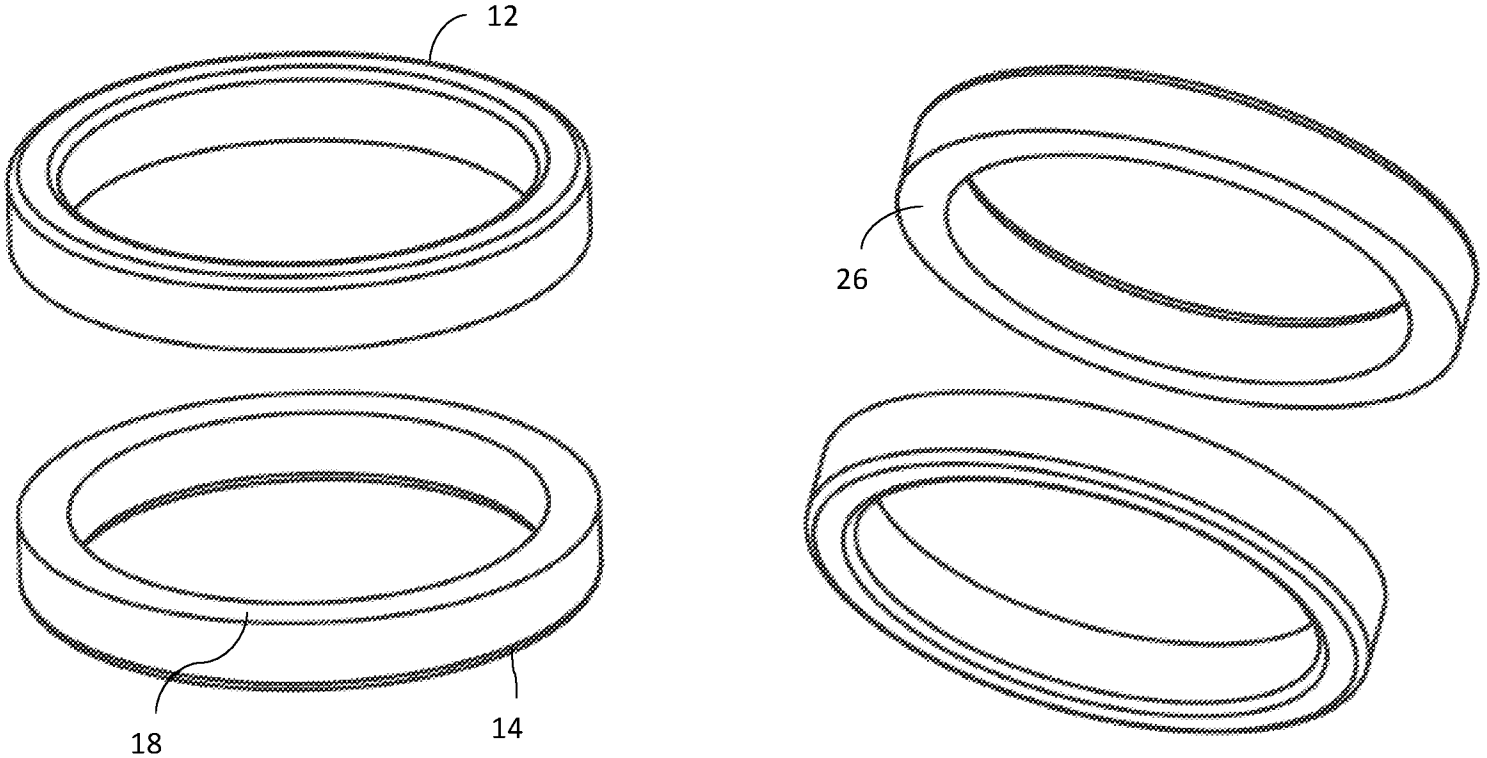
FIG. 6 is an example of the ring system in a disassembled state. The main ring and the accessory ring have a magnetic fastener for a fastener.

Referring to FIG. 6, the main ring 12 can have a magnet embedded in the ring and the accessory ring 14 can have magnetic material. The magnet and magnetic material can be situated such that when the surface 18 of the main ring 12 is in close proximity to the surface 26 of the accessory ring 14, magnetic attraction between the magnet and the magnetic material secures the main ring 12 to the accessory ring 14. The main ring 12 can have a protrusion 16 which extends into a cavity 24 of the accessory ring to ensure concentricity of the openings 20 and 28 of the main ring 12 and the accessory 14.

Instead of a magnet embedded into the main ring 12, either of the rings can be magnetic and the other ring made of a magnetically reactive material.

Mating fasteners often have portions designated as "male" and corresponding portions designated as "female." The male and female portions of the fasteners can be on the main ring and the accessory ring respectively, or vice versa, depending on the aesthetic and/or practical requirements of the main ring and the accessory ring designs.

Below is a practical example of the device disclosed by the present application.

A main ring 12 can be made of platinum, the cross section of the ring band being a rectangle with at least one rounded corner. The rounded corner creating a rounded edge on one of the outer diameter corners of the ring. The other outer diameter edge can be a sharp edge to create a seamless joint between the main ring 12 and an accessory ring 14. The long edge of the rectangular cross section can travel through the inner diameter of the ring and join two opposing, ring-shaped surfaces of the ring.

The main ring 12 can have a circular opening 20 bounded by an inner circumferential surface 13 through the center of the ring, through which a finger can pass to wear the main ring 12. The main ring can have a surface 18 extending radially from the inner circumferential surface 13 and intersecting with an outer diameter surface of the main ring 12 at the sharp edge. From the surface 18 there can be a protrusion 16 that is annular in shape and surrounds the circular opening 20 of the main ring 12. The protrusion 16 can have an outer surface upon or into which helical threads 22 can be formed. The protrusion 16 and the thread pitch can be sized such that multiple threads are formed along the length of the protrusion 16.

An accessory ring 14 can be made out of 14K yellow gold, the cross section of the ring band being a square and one corner being rounded. The rounded corner can create a rounded edge on one of the outer diameter corners of the ring. The other outer diameter edge can be sharp to create a smooth transition between the outer circumferential surfaces 15 of the main ring 12 and the accessory ring 14 when the rings 12 and 14 are assembled or secured to each other.

The accessory ring 14 can have a cavity 24 cut into the square cross section and a surface 26. The cavity 24 can be annular in shape and surround the opening 28 of the accessory ring 14. The cavity can have an outer diameter surface 32 upon which, or into which, a helical thread 30 can be formed. The cavity 24 and thread pitch can be sized such that multiple threads are formed along the depth of the cavity 24. The helical thread 30 of the accessory ring 14 can be formed such that they interlock, or thread on to, the helical thread 22 of the main ring 12.

To secure the main ring 12 to the accessory ring 14, the helical threads 22 and 30 can be brought into contact, the surfaces 18 and 26 facing each other. The helical threads 22 and 30 can be engaged by rotating one ring 12 or 14 in relation to the other ring 12 or 14 until the surfaces 18 and 26 are abutting. The ring 12 can be secured to the accessory ring 14 to make the assembly 10, without the use of tools. The main ring 12 can be unsecured from the accessory ring 14 by unthreading of the rings 12 and 14 from each other without the use of tools.

A further example incorporates the example above in its entirety and includes an intermediary ring. The intermediary ring can be made with any of the materials and by any of the processes included in this application. The intermediary ring can have a cavity in a ring-shaped surface of the ring with a helical thread that is formed to mate with the helical thread 22 of the main ring 12. On an opposing ring-shaped surface, the intermediary ring can have a protrusion similar to the main ring 12. The intermediary ring can have a helical thread formed on or in a surface of the protrusion, similar to that described on the main ring 12 above. The intermediary helical thread on the intermediary ring protrusion can be formed to mate with the helical thread 30 of the accessory ring 14.

The intermediary ring can be secured to the main ring 12 and/or the accessory ring 14 by threading each of the main ring 12 and the accessory ring 14 on the corresponding mating helical thread on the intermediary ring.

A further example herein incorporates the two examples above in their entirety and can include multiple intermediary rings. The intermediary rings can have helical coils whereby multiple intermediary rings can be secured to each other forming a stack of intermediary rings. On one end of the intermediary ring stack a main ring 12 can be secured using the method described above. On the other end of the intermediary ring stack, an accessory ring 14 can be secured using the method above.

The examples above can, instead of a helical thread, include any of the fastening devices and methods disclosed in this application.

Figure 7:
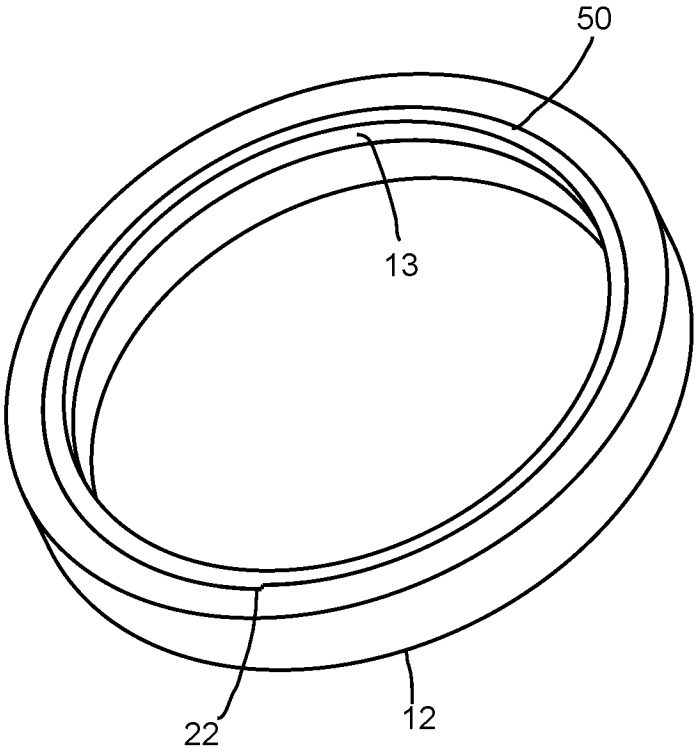
FIG. 7 is an example of the ring system with a silicone insert ring. The silicone ring is inserted into the main ring.

Referring to FIG. 7, an example of the main ring 12 with a cavity 24 is shown with an insert ring 50 inserted into the cavity 24. The insert ring 50 can have an external helical thread 22 corresponding to the internal helical thread 30 of the main ring. The external helical thread 22 of the insert ring 50 can be of the same thread design standard or a different thread design standard from the helical thread 30 of the main ring 12 as long as the threads 22 and 30 interlock. There can be a resistance fit between the threads 22 and 30. The helical threads 22 of the insert ring can be formed by molding, cutting, or any other thread forming method.

The insert ring 50 can be constructed from a number of materials including, but not limited to, silicon, plastic, rubber, metal, wood, resin-reinforced fiber composite, hard wax, stone, glass, fiber composite, resin, or any composite of flexible or inflexible, solid materials.

The insert ring 50 is constructed to insert into the cavity 24 of the main ring 12 to protect a wearer of the main ring 12 from the exposed threads and edges of the cavity 24 of the main ring 12. The insert ring 50 inner diameter surface 13 can be the same inner diameter 13 as the main ring 12 or a slightly different diameter to aid in wearability of the main ring 12. The insert ring 50 can protrude axially, perpendicular to the radial direction of the ring, from the main ring 12 or lay flush with the surface of the main ring perpendicular to a central axis through the main ring 12 inner diameter.

The insert ring 50 can have tool accepting features that provide surfaces with which an insertion/removal tool can interact. These tool accepting surfaces can include, but are not limited to, blind holes, radial grooves, annular slots, knurls, detent holes, or any other feature known in the art for providing a surface against which a tool can engage an object to rotate the object.

Figure 8:
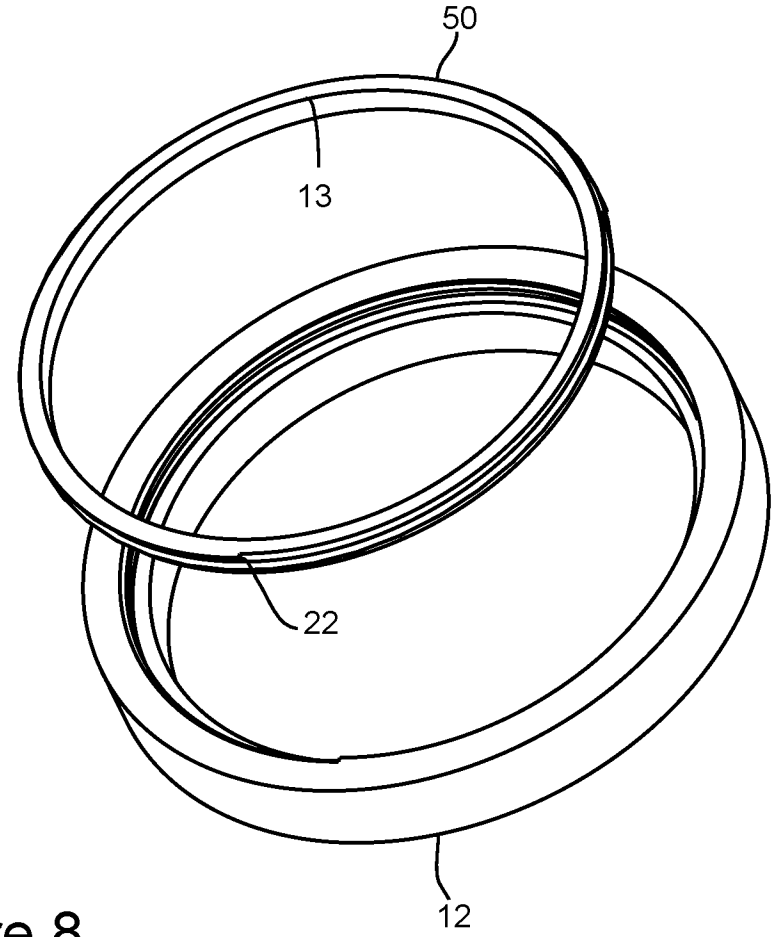
FIG. 8 is an example of the ring system with a silicone insert in an exploded view.

Referring to FIG. 8, an example of the insertion ring 50 and the main ring 12 is shown in an exploded view. The exterior helical threads 22 are more clearly shown in FIG. 8.

The examples, and combinations thereof, of the disclosed device can be applied to an engagement ring. The connecting ring device is uniquely suited to the engagement ring application because often a wedding ring is provided to be worn on the same finger as an engagement ring. Any ring of the connected ring assembly can be an engagement ring. This engagement ring can be attached to another ring, including a wedding ring, with the above-referenced fasteners. Configurations of the wedding and engagement rings can vary. The engagement ring and wedding ring can have varying shapes, ornamental protrusions, ornamental embossments, ornamental markings, gem stones, engravings, or any other structural feature known in the art of ring making.

What is claimed is:

1. A ring system comprising:

a first ring and a second ring, the first ring and the second ring each having an inner circumferential surface and an outer circumferential surface;

the first ring and the second ring each having a first surface and a second surface, the second surface opposing the first surface;

the first ring and the second ring each having a fastener on the respective first surfaces, the first ring and the second ring each releasably fastenable to each other using the fastener of the first ring and the fastener of the second ring to make a fastened state;

the first and the second surfaces of the first and second rings each radially extending from the inner circumferential surface to the outer circumferential surface of the first and second rings;

the first surface of the first ring and the first surface of the second ring abutting each other when the first ring and the second ring are in the fastened state;

each outer circumferential surface of the first and second rings having an outer diameter, the outer diameter being the largest diameter of the outer circumferential surface;

the first ring and the second ring each having a circumferential edge where the first surface and the outer circumferential surface of the first and second rings intersect, respectively, each circumferential edge having a diameter, the diameter of the circumferential edge of the first ring being equal to the outer diameter of the first ring and the diameter of the circumferential edge of the second ring being equal to the outer diameter of the second ring;

the fastener of the first ring having a protrusion, the protrusion having an outer circumferential surface smaller in diameter than the outer diameter of the first ring; and the first surface of the second ring having a cavity into which the protrusion of the first ring extends;

a third ring having an overall thickness measured perpendicular to an outer diameter of the third ring, an inner circumferential surface with a diameter and an outer circumferential surface with a diameter, a first surface, a second surface, and a fastener on the outer circumferential surface;

the second surface of the third ring opposing the first surface of the third ring;

the first surface and the second surface of the third ring each radially extending from the inner circumferential surface to the outer circumferential surface of the third ring;

the cavity of the second ring having a depth, the depth measured from the first surface of the second ring to a bottom surface of the cavity;

the overall thickness of the third ring being no larger than the depth of the cavity of the second ring;

the second ring and the third ring releasably fastenable to each other using the fastener of the second ring and the fastener of the third ring to make a fastened state;

the first surface of the third ring abutting the bottom surface of the cavity when the second ring and the third ring are in a fastened state; and the fastener of the second ring and the fastener of the third ring interconnected when the second ring and the third ring are in the fastened state.

2. The system of claim 1, further comprising:

the fastener of the first ring having a magnet; and the fastener of the second ring having magnetic material.

3. The system of claim 1, further comprising:

the fastener of the first ring having magnetic material; and the fastener of the second ring having a magnet.

4. The system of claim 1, further comprising the fasteners of the first ring and of the second ring having corresponding helical threads.

5. The system of claim 1, further comprising the fasteners of the first ring and of the second ring having a corresponding bayonet connection.

6. The system of claim 1, wherein the fastener of the first ring is at least one pin and the fastener of the second ring is at least one bore.

7. The system of claim 1, wherein the cavity of the second ring is annular.

8. The system of claim 1, wherein the cavity of the second ring extends to the inner circumferential surface of the second ring.

9. The system of claim 1, wherein the protrusion of the first ring is annular.

10. The system of claim 1, further comprising:

the first ring having an overall thickness measured perpendicular to the outer diameter of the first ring;

the protrusion of the first ring having a thickness measured perpendicular to the outer diameter of the first ring and from the first surface of the first ring to an end of the protrusion of the first ring; and the thickness of the protrusion of the first ring equal to less than half of the overall thickness of the first ring.

11. A ring system comprising:

a first ring and a second ring, the first ring and the second ring each having an inner circumferential surface and an outer circumferential surface;

the first ring and the second ring each having a first surface and a second surface, the second surface opposing the first surface;

the first and the second surfaces of the first and second ring each radially extending from the inner circumferential surface to the outer circumferential surface of the first and second ring, respectively;

the first ring having a fastener on the first surface, the fastener of the first ring being a cavity in the first surface of the first ring, a depth of the cavity measured from the first surface of the first ring to a bottom surface of the cavity;

the second ring having a fastener on the outer circumferential surface of the second ring;

the first ring and the second ring each releasably fastenable to each other using the fastener of the first ring and the fastener of the second ring to make a fastened state;

the bottom surface of the cavity and the first surface of the second ring abutting each other when the first ring and the second ring are in the fastened state;

the fasteners of the first ring and the second ring interconnecting when the first ring and the second ring are in a fastened state.

12. The system of claim 11, further comprising:

the fastener of the first ring having a magnet; and the fastener of the second ring having magnetic material.

13. The system of claim 11, further comprising:

the fastener of the first ring having magnetic material; and the fastener of the second ring having a magnet.

14. The system of claim 11, further comprising the fastener of the first ring and of the second ring having corresponding helical threads.

15. The system of claim 11, further comprising the fastener of the first ring and of the second ring having a corresponding bayonet connection.

16. A ring system comprising:

a first ring and a second ring, the first ring and the second ring each having an inner circumferential surface and an outer circumferential surface;

the first ring and the second ring each having a first surface and a second surface, the second surface opposing the first surface;

the first ring and the second ring each having a fastener on the respective first surfaces, the first ring and the second ring each releasably fastenable to each other using the fasteners of the first and second ring to make a fastened state;

the first and the second surfaces of the first and second ring each radially extending from the inner circumferential surface to the outer circumferential surface of the first and second ring;

the first surface of the first ring and the first surface of the second ring abutting each other when the first ring and the second ring are in the fastened state;

each outer circumferential surface of the first and second ring having an outer diameter, the outer diameter being the largest diameter of the outer circumferential surface;

the first ring and the second ring each having a circumferential edge where the first surface of the first and second ring and the outer circumferential surface of the first and second ring intersect, respectively, the diameter of the edge of the first ring being equal to the outer diameter of the first ring and the diameter of the edge of the second ring being equal to the outer diameter of the second ring;

the second ring having a protrusion extending from the second surface of the second ring;

a third ring, the third ring having an inner circumferential surface and an outer circumferential surface;

the third ring having a first surface and a second opposing surface, the first and second surfaces of the third ring each extending radially from the third ring inner circumferential surface to the third ring outer circumferential surface;

the second ring having a second fastener on the second surface of the second ring and the third ring having a fastener on the first surface, the second ring and the third ring releasably fastenable to each other using the second fastener of the second ring to the fastener of the third ring to make a fastened state; and the second surface of the second ring and the first surface of the third ring abutting each other when the second ring and the third ring are in the fastened state.

17. The system of claim 16, further comprising:

the fastener of the first ring having a magnet; and the fastener of the second ring having magnetic material.

18. The system of claim 16, further comprising:

the fastener of the first ring having magnetic material; and the fastener of the second ring having a magnet.

19. The system of claim 16, further comprising the fastener of the first ring and of the second ring having corresponding helical threads.

20. The system of claim 16, further comprising the fastener of the first ring and of the second ring having a corresponding bayonet connection.

* * * * *